US005106015A

United States Patent [19]

Vlasaty et al.

[11] Patent Number: 5,106,015

[45] Date of Patent: Apr. 21, 1992

[54] CONTAINER

[75] Inventors: Frank Vlasaty, Huntley, Ill.; Robert J. Smith, Rapid City, S. Dak.

[73] Assignee: American Colloid Company, Arlington Heights, Ill.

[21] Appl. No.: 729,932

[22] Filed: Jul. 15, 1991

[51] Int. Cl.[5] ..... B65D 5/74

[52] U.S. Cl. ..... 229/125.15; 222/540; 229/117.24

[58] Field of Search ..... 229/125.14, 125.15, 229/160.2, 117.24; 220/462, 465, 416; 222/540; 206/621.2

[56] References Cited

U.S. PATENT DOCUMENTS

| | | | |
|---|---|---|---|
| 2,483,464 | 10/1949 | Johnson . | |
| 3,054,549 | 9/1962 | Humphrey | 220/465 |
| 3,233,817 | 2/1966 | Casady | 220/465 |
| 3,335,924 | 8/1967 | Miller | 229/125.15 |
| 3,765,574 | 10/1973 | Urquiza | 222/183 |
| 3,886,901 | 6/1975 | Zeitter | 119/1 |
| 4,030,448 | 6/1977 | Nuttall | 119/1 |
| 4,153,089 | 5/1979 | Veilleux | 150/7 |
| 4,572,422 | 2/1986 | Heuberger et al. | 220/462 |
| 4,800,842 | 1/1989 | Jones, Jr. | 119/1 |
| 4,858,561 | 8/1989 | Springer | 119/1 |
| 4,971,243 | 11/1990 | Lisiecki | 229/125.15 |

FOREIGN PATENT DOCUMENTS

| | | | |
|---|---|---|---|
| 34824 | 9/1981 | European Pat. Off. | 220/462 |
| 3800883 | 7/1989 | Fed. Rep. of Germany | 229/160.2 |
| 3829606 | 3/1990 | Fed. Rep. of Germany | 220/462 |
| 1315595 | 12/1962 | France | 206/621.2 |
| 982792 | 2/1965 | United Kingdom | 220/416 |

*Primary Examiner*—Gary E. Elkins

*Attorney, Agent, or Firm*—Marshall, O'Toole, Gerstein, Murray & Bicknell

[57] ABSTRACT

A container having four vertical sides, a top side and a bottom side, the six sides being connected to form a cube. The six sides are joined at the edges of the cube, and the juncture of one vertical edge with two upper edges forms a slanted surface. A pouring spout is mounted on the slanted surface and is inset from the planes of the adjacent sides so that it does not interfere with nesting and stacking. A handle is attached to the top side, at approximately its center, for carrying purposes, the handle being foldable to a flat position to facilitate stacking. The container is formed by cutting a blank from a flat sheet of relatively stiff material, and folding the blank along creases to form a closed container. The top and four sides are folded and sealed first, the pouring spout is installed, the container is filled through the open bottom side, and then the bottom side is folded and sealed.

10 Claims, 6 Drawing Sheets

CONTAINER

FIELD AND BACKGROUND OF THE INVENTION

This invention relates to containers or packages, and more particularly to an improved container for shipping, storing and dispensing granular material.

There are, of course, numerous designs of containers on the market and shown in prior patents, for use with a wide variety of products. Containers of the character described herein are designed to hold a product (such as a granular cat litter) during shipping, storage and display on a store shelf or counter, and to facilitate pouring of the product from the container.

The Urquiza U.S. Pat. No. 3,765,574 discloses a Container For Liquids having a generally square or rectangular configuration with a pouring spout formed in a recessed portion of a top wall of the container. Such a square or rectangular shape makes it possible to ship compactly, store and/or display the container because a number of such containers may be stacked closely adjacent and on top one another. However, the container of this patent has the disadvantage that it is a molded plastic product, which is relatively expensive, and the container must be filled through the pouring spout. Further, the pouring spout extends straight upwardly, which can be an inconvenience when pouring.

The Johnson U.S. Pat. No. 2,483,464 describes a container having a triangular cross-section and a pouring spout which is formed at a slanted upper corner. According to this patent, this design permits compact nesting for storage and the containers are stackable. However, if the containers were compactly nested as described, every other container would have to be turned backwards. Further, the joined edges of the various sides forming the container are bent outwardly to form flanges which are sealed together. It is believed that such an arrangement would be expensive to manufacture and would make stacking difficult.

| NUMBER | PATENTEE | DATE |
|---|---|---|
| 3,886,901 | C. R. Zeitter | 06-03-75 |
| 4,030,448 | J. Nuttall | 06-21-77 |
| 4,153,089 | R. L. Veilleux | 05-08-79 |
| 4,800,842 | G. C. Jones | 01-31-89 |
| 4,858,561 | H. T. Springer | 08-22-89 |

It is a general object of the present invention to provide an improved container which is relatively inexpensive to manufacture, may be compactly stacked, and has a convenient pouring spout.

SUMMARY OF THE INVENTION

A container constructed in accordance with this invention has four vertical sides, a top side and a bottom side, the six sides being connected to form a cube. The six sides are joined at the edges of the cube, and the juncture of one vertical edge with two upper edges forms a slanted surface. A pouring spout is mounted on the slanted surface and is inset from the planes of the adjacent sides so that it does not interfere with nesting and stacking. A handle is attached to the top side, at approximately its center, for carrying purposes, the handle being foldable to a flat position to facilitate stacking.

The container is formed by cutting a blank from a flat sheet of relatively stiff material, and folding the blank along creases to form a closed container. The top and four sides are folded and sealed first, the pouring spout is installed, the container is filled through the open bottom side, and then the bottom side is folded and sealed.

DETAILED DESCRIPTION

Figure 1:
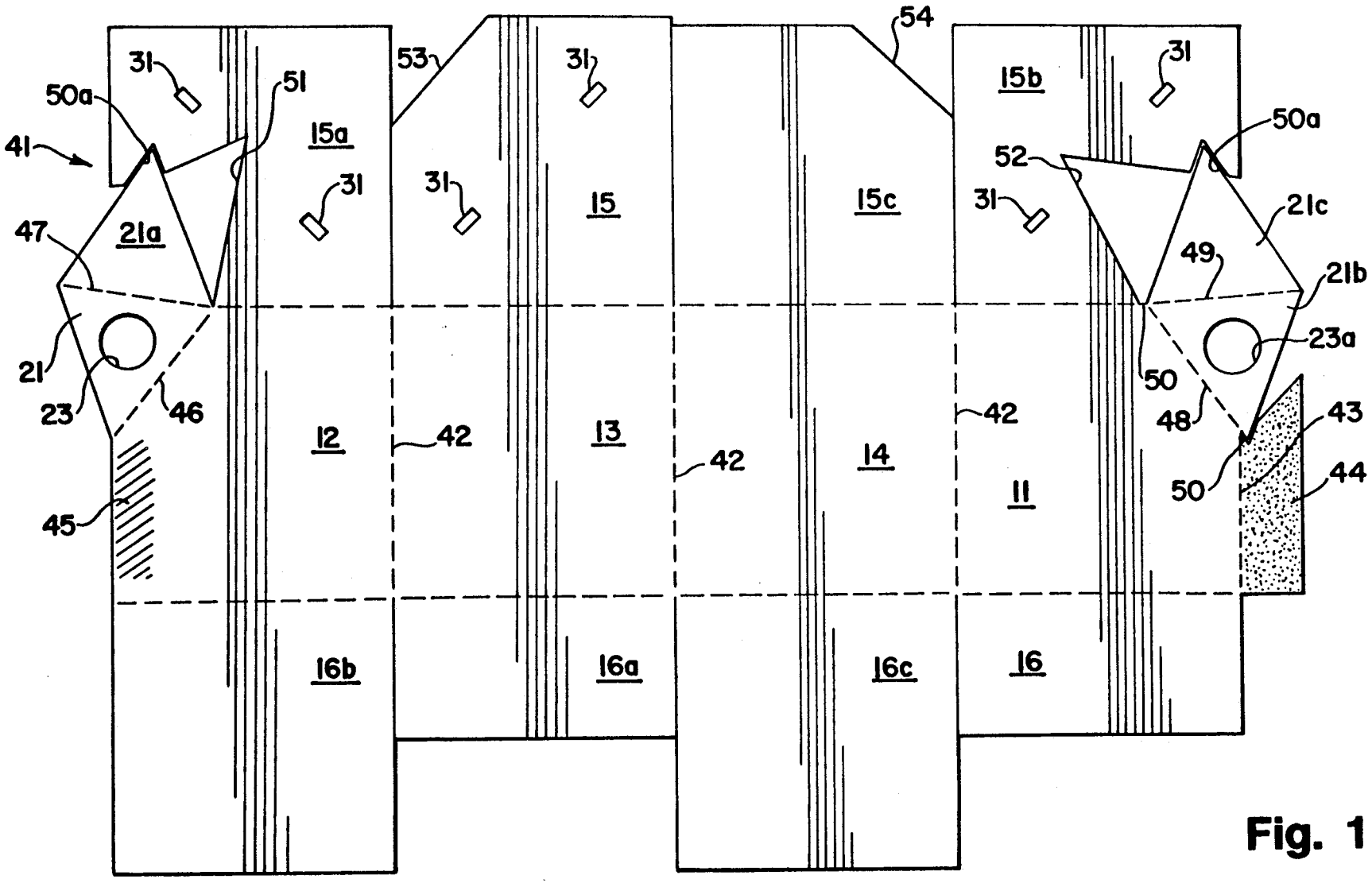
FIG. 1 is a plan view of a flat blank before folding to form the container.
Figure 11:
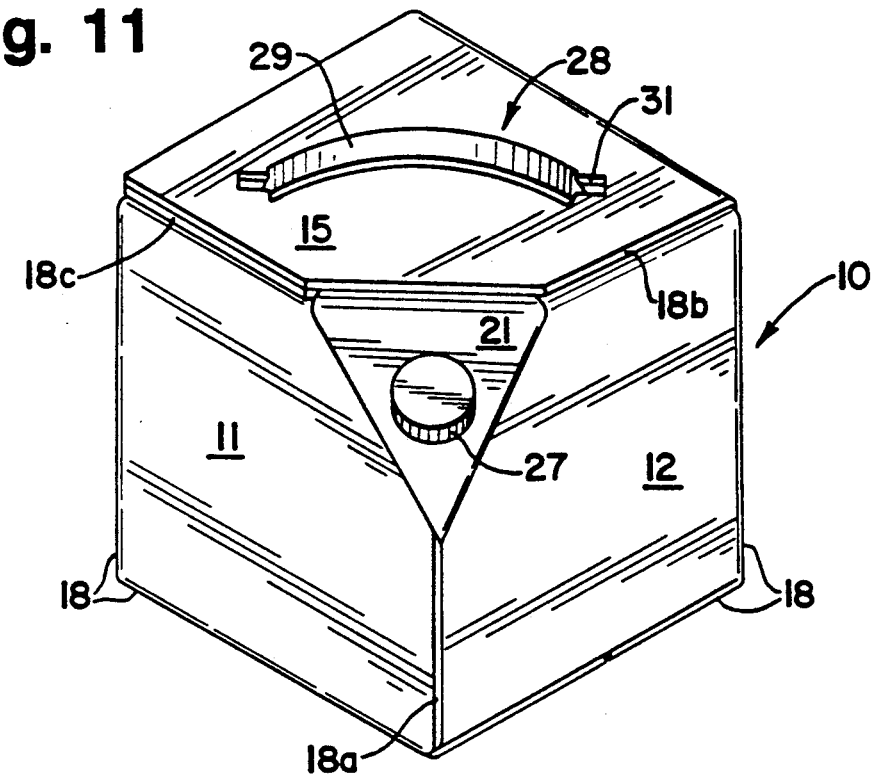
FIG. 11 is a perspective view of a folded and sealed container constructed in accordance with the present invention.
Figure 12:
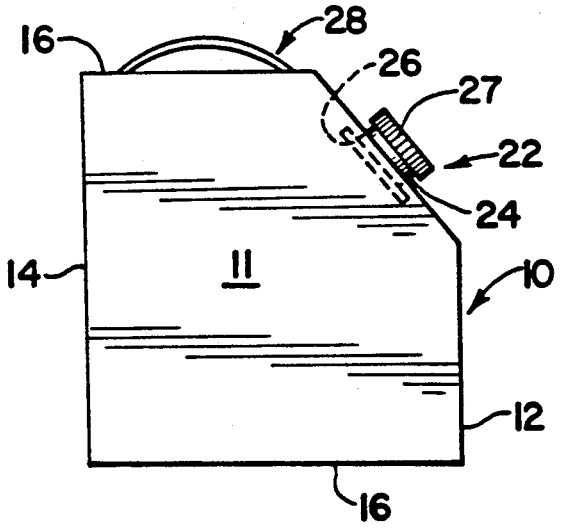
FIG. 12 is a side elevational view of the container of FIG. 11.

With reference first to FIGS. 11 and 12, a completely folded and sealed container 10 includes four vertical sides 11 to 14; the sides 13 and 14 are not shown in FIG. 1 but are square or rectangular. In addition, the container includes a top side 15 and a bottom side 16. The six sides 11 to 16 are joined along edges 18 and form a cube. The term cube as used herein includes both shapes wherein each side is square and shapes wherein at least some sides are rectangular.

At the juncture of one vertical edge 18*a* and two upper edges 18*b* and 18*c* is formed a slanted triangle-shaped wall 21, and a pouring spout 22 is mounted at approximately the center of the wall 21. A round hole 23 is formed through the wall 21, and the spout 22 includes a tubular part 24 which extends through the hole 23, and a radially extending flange 26, which is formed on the interior end of the part 24. The tubular part 24 has a tight fit in the hole 23, and the flange 26 is on the interior side of the wall and both forms a seal between the wall 21 and the spout 22 and prevents the spout 22 from falling out of the hole during use. The outer end of the tubular part is threaded and a sealing cap 27 is screwed on the spout, the cap being removed, of course, before the contents of the container are poured out.

It is a feature of this invention that the cap 27 is inset or recessed slightly inwardly from the planes of the three adjacent sides 11, 12 and 15. This inset avoids interference with the cap 27 when other containers (not illustrated) are stacked against the sides 11 and/or 12 and/or stacked on top of the top side 15.

A collapsible handle 28 is fastened to or within the top side 15 to facilitate carrying the container. The handle 28 includes a bowed gripping part 29 and wings at both ends of the part 29. The ends of the handle 28 extend through holes 31 formed in the top side 15 and the wings engage an undersurface of the top side 15 when the handle is pulled up. In the present example, the handle is made of a flexible material so that the gripping part 29 may be pressed down flat against an upper surface of the top side 15 to allow containers to be stacked one on top of another.

FIG. 1 shows a single-piece flat blank 41 from which the carton is formed, the blank being cut from a flat sheet of relatively stiff material such as cardboard. The solid lines in FIG. 1 represent through cuts while the dashed lines represent crease or fold lines.

The blank 41 includes the previously mentioned four sides 11 to 14 which are joined by fold lines 42. Along one edge 43 of the side 11 is cut a glue tab 44 which, during assembly, is glued to an interior surface area 45 of the side 12. Extending downwardly (as seen in FIG. 1) from the sides 11 to 14 are bottom wall sections 16, 16*b*, 16*a* and 16*c*, respectively. Extending upwardly from the sides 11 to 14 are top wall sections 15*b*, 15*a*, 15 and 15*c*, respectively.

Also extending upwardly from the side 12 and joined to it along a fold line 46 is the triangular wall 21, and joined to the wall 21 along a fold line 47 is a similar triangular wall 21*a*. Similarly, triangular walls 21*b* and 21*c* are joined together and to the side 11 along fold lines 48 and 49. The fold lines 47 and 49 slant upwardly relative to the upper edges of the sides 11 and 12 so that the lines 47 and 49 are in line with the upper edges when the blank is folded. The two triangular walls 21*b* and 21*c* are offset toward edge 43 from the side 11 by the spaces 50 to provide clearance for folding the parts, and notches 50*a* are cut in the top side sections 15*a* and 15*b* to allow formation of the outer tips of the triangular walls 21*a* and 21*c*. Round holes 23 and 23*a* are cut in the triangular walls 21 and 21*b*, which receive the pouring spout 22.

Two rectangular holes 31 are cut in the top side sections 15, 15*a* and 15*b*, which receive the ends of the handle 28. It will be noted that the section 15*c* is formed without such holes.

Figure 2:
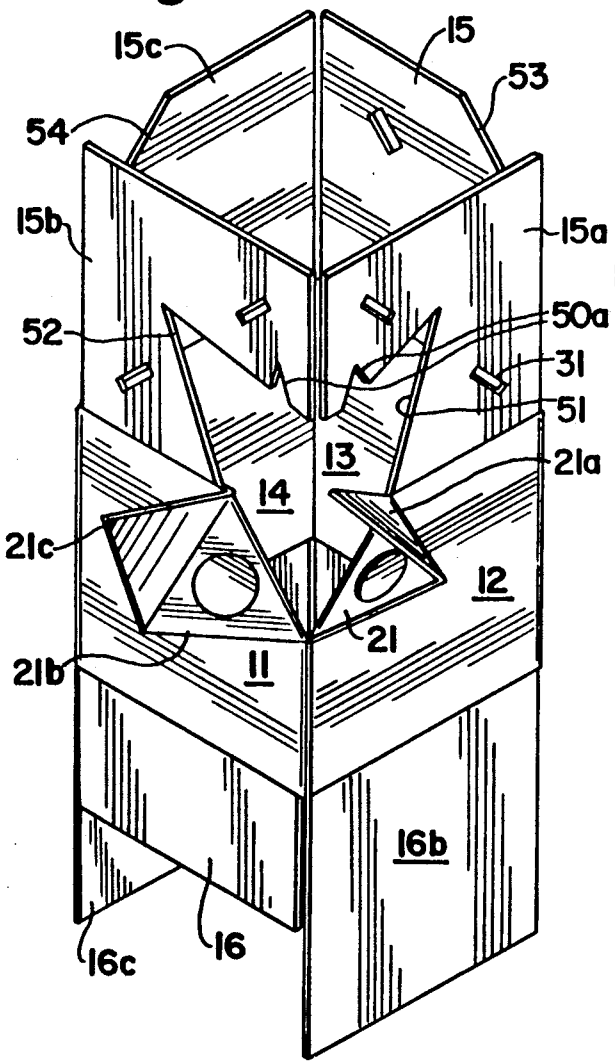

After cutting the blank 41 and forming the fold lines, the container is assembled as follows:

(1) The blank is folded on the lines 42, glue is applied to the tab 43 and/or to the surface 44 and they are glued together (FIG. 2).

Figure 3:
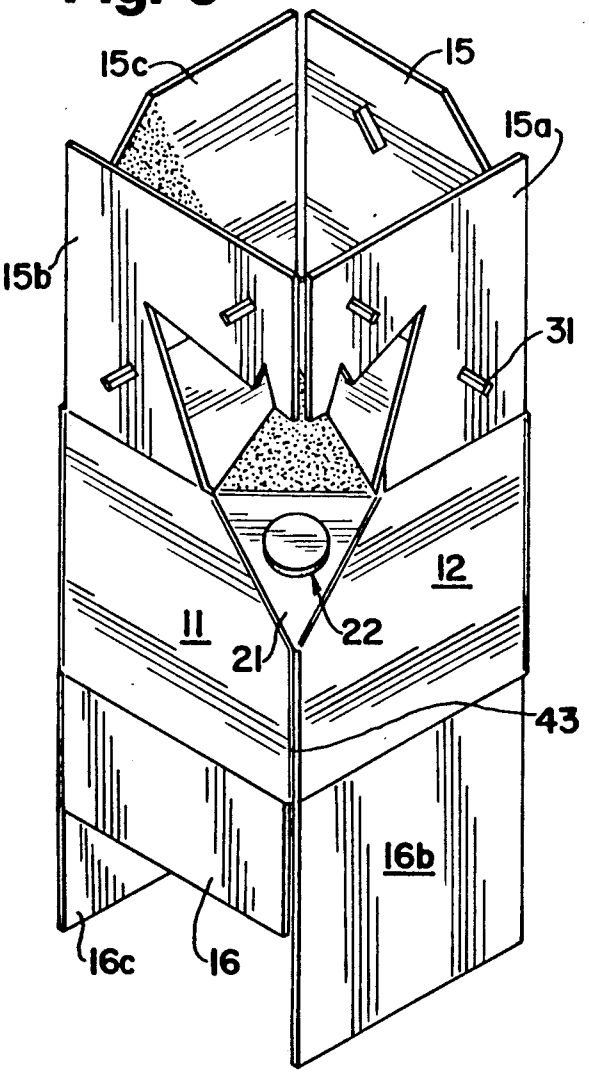

(2) The sides 11 to 14 are positioned at 90° angles; the triangular walls 21 and 21*a* overlie the walls 21*b* and 21*c*, respectively, and glue is applied on the adjoining surfaces of the walls 21, 21*a*, 21*b* and 21*c* (FIG. 3).

(3) The holes 23 and 23*a* are positioned in alignment, and the pouring spout 22 is mounted through these holes; the flange 26 (FIG. 12) is pressed tightly against the interior surface of the wall 21*b* around the hole 23*a*; and the cap 27 is tightly screwed on the spout 22 (FIG. 3).

Figure 4:
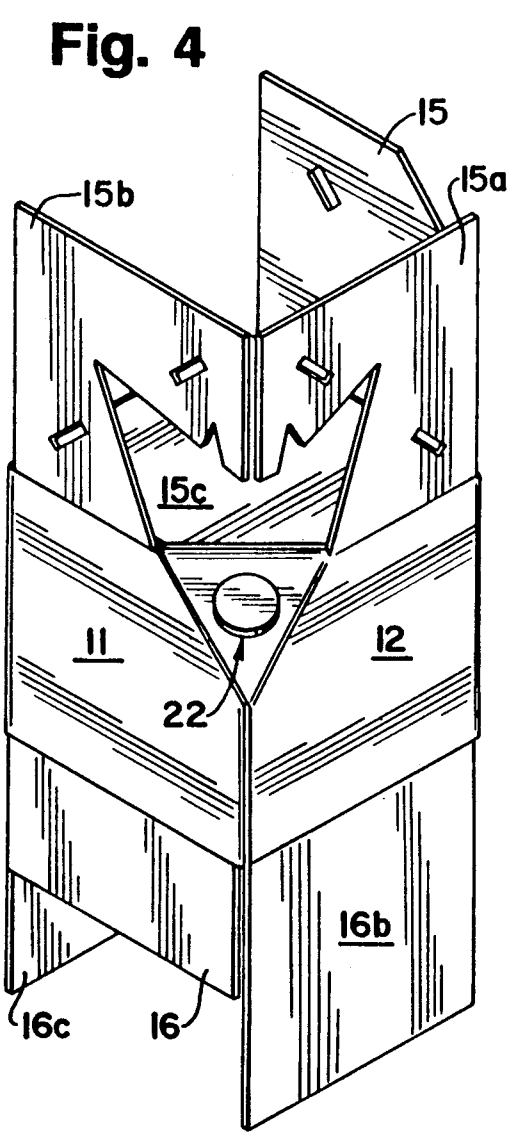
FIGS. 2 to 10 are views showing the folding and sealing steps for forming the container.

(4) The top side section 15*c* is folded down over the top of the opening (FIG. 4), then glue is applied to the underside of the triangular wall 21*c*, and the wall 21*c* is glued to the upper side of the side 15*c*.

Figure 5:
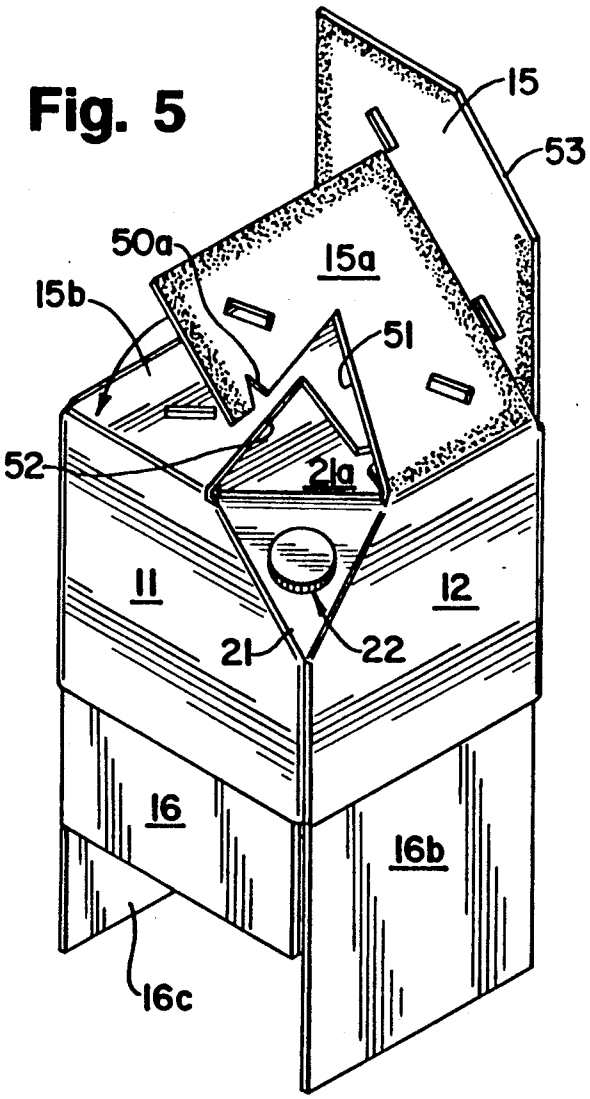

(5) In succession, the top sides 15*b*, 15*a* and 15 are folded down over the side 15*c*, with glue being applied between the adjoining surfaces of the walls 15 and 15*a* (FIG. 5). The triangular walls 21*a* and 21*c* extend in the plane of the top wall 15 and fit in cutouts 51 and 52 formed in the top sides 15*a* and 15*b*. The two top sides 15 and 15*c* have corners cut out along lines 53 and 54 (see FIG. 1), and these lines 53 and 54 extend along the fold lines 47 and 49 when the top side is fully assembled.

Figure 6:
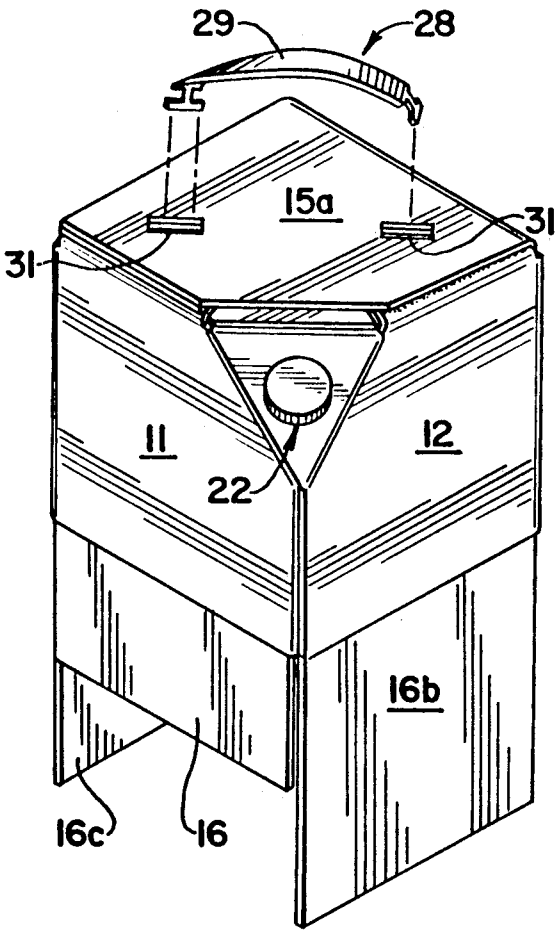
Figure 7:
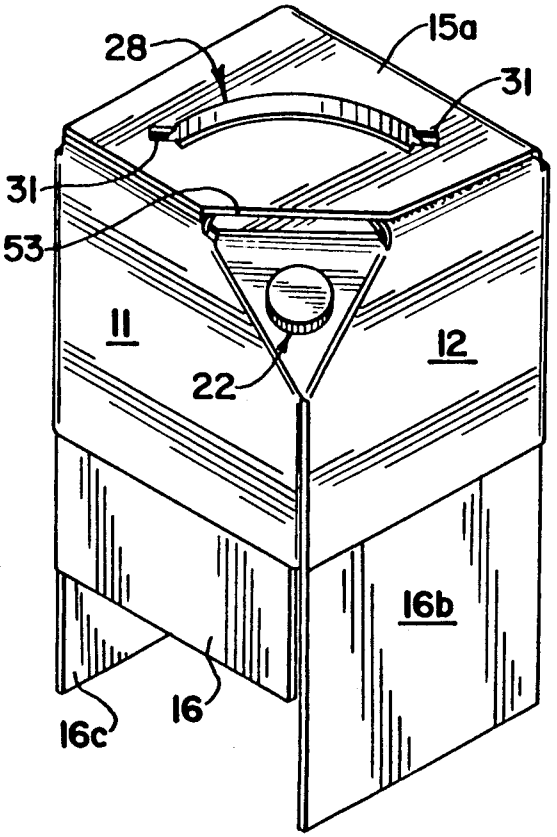

(6) In the embodiment shown in FIGS. 1–12, the holes 31 of the top sides 15, 15*a* and 15*b* are aligned, and the ends of the handle 28 are inserted into them (FIG. 6). The handle is flat and relatively thin, and the thin dimension is aligned with the long dimension of the holes 31. The handle is then turned sideways so that the wings at the ends of the handle extend between the side sections 15*b* and 15*c* (FIG. 7). In the preferred embodiment shown in FIGS. 14–16 a separate integral handle is glued to top side 15*b* so that the handle extends upwardly through the top sides 15*a* and 15, after the entire handle portion 28*a* is secured to top side 15*b*.

(7) The carton is turned over so that the bottom wall sections 16–16*c* extend upwardly, and the top wall section 15*c* is pressed down firmly against the top wall sections 15–15*b*.

Figure 8:
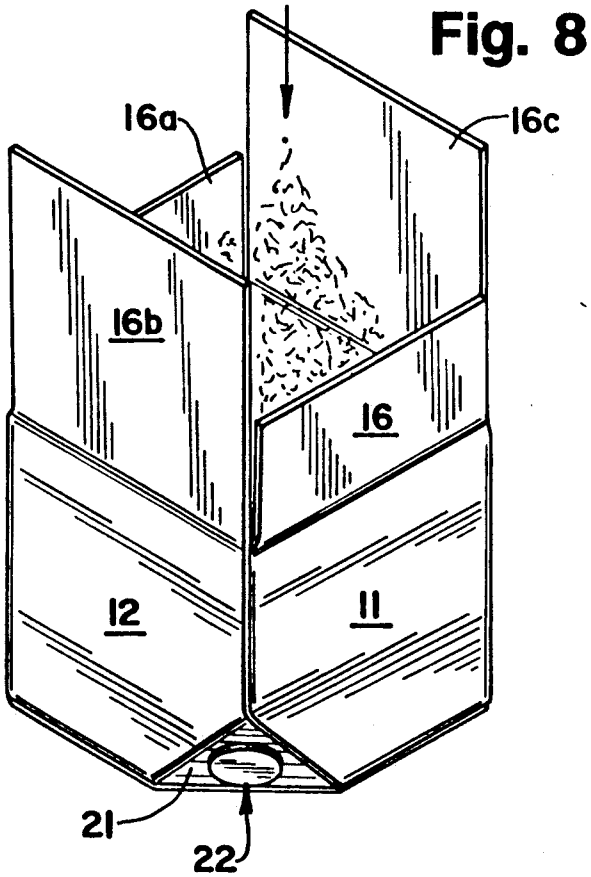

(8) The carton is filled through the open bottom side (FIG. 8).

Figure 9:
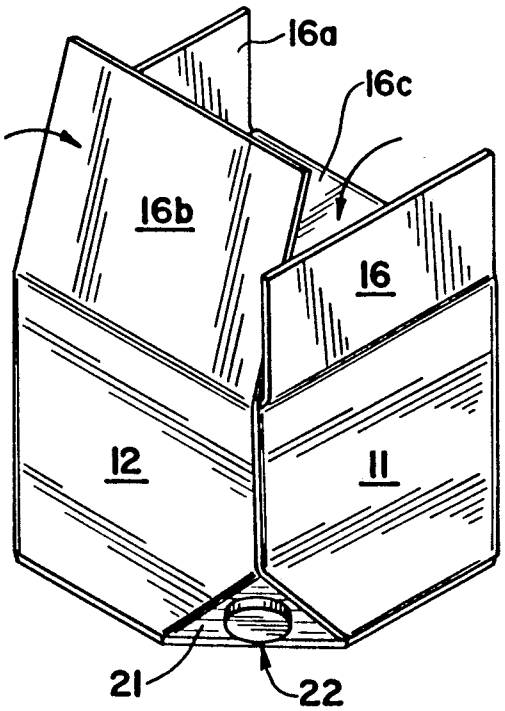
Figure 10:
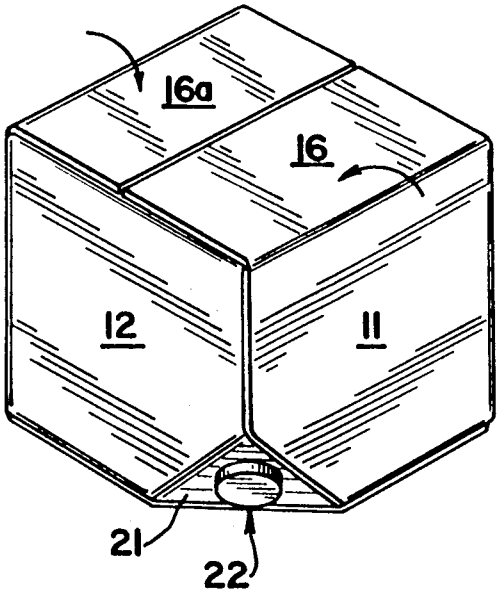

(9) After filling, the bottom side section 16*c* is folded down, then section 16*b*, and the sections 16 and 16*a* (FIGS. 9 and 10). Glue is applied between the adjoining surfaces of the sections 16, 16*a* and 16*b*.

The carton is thus fully assembled, filled and, after inversion to the FIG. 1 position, ready for use. To remove some of the contents of the carton, the cap 27 is removed, the carton is lifted by one hand using the handle 28, and the pouring spout is tipped downwardly by lifting the opposite corner of the carton using the other hand.

Figure 13:
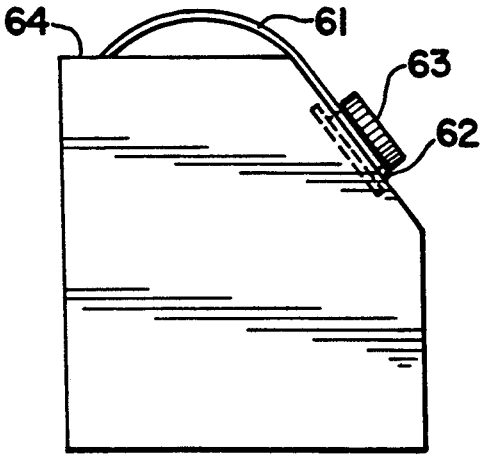
FIG. 13 shows an alternate arrangement of a handle of the container.
Figure 14:
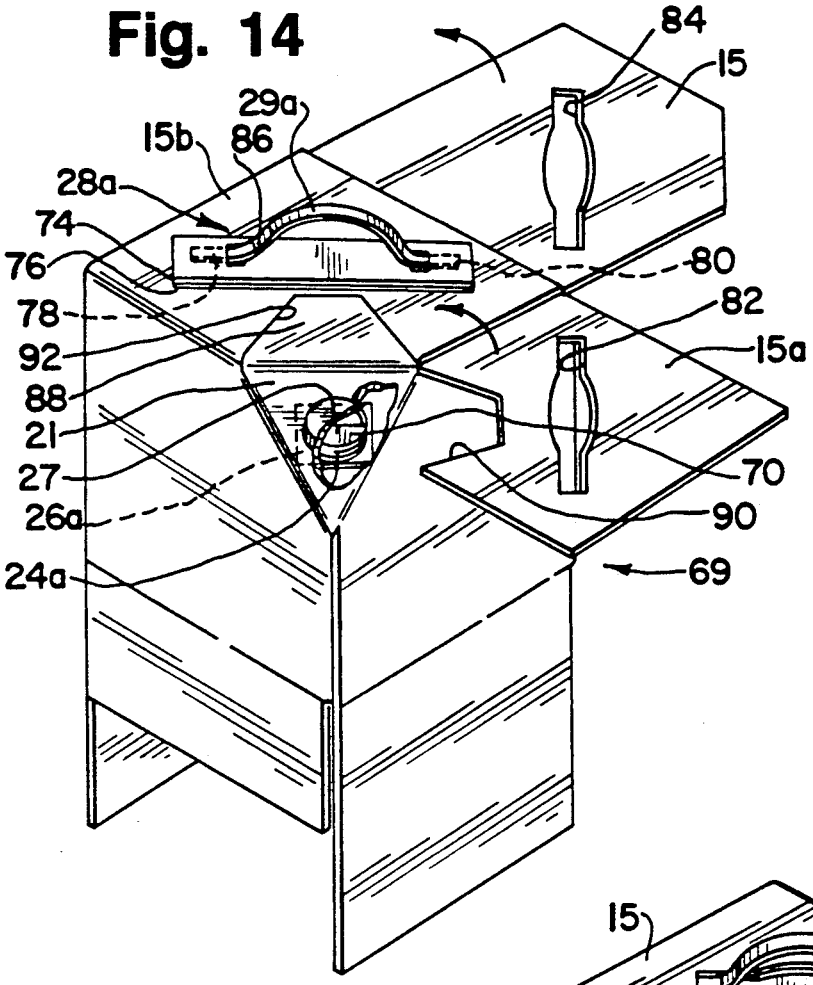
FIGS. 14 to 16 show a preferred embodiment of handle and spout portions of the container of the present invention, with slight modifications to the container of FIGS. 1-12.
Figure 15:
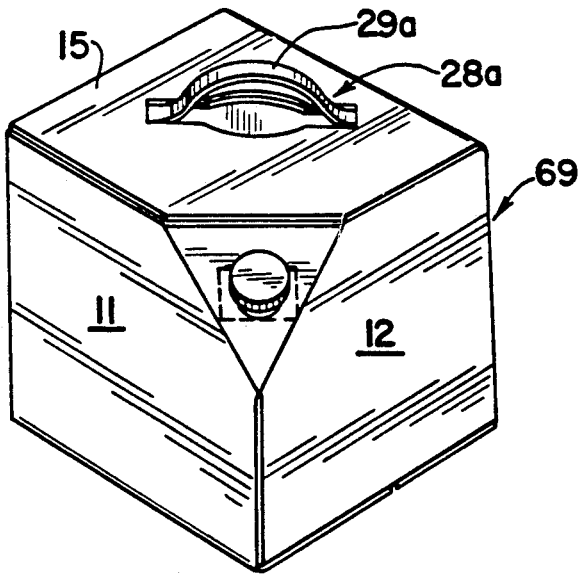

FIGS. 13–15 illustrate alternate arrangements of the flexible handle, with the preferred embodiment shown in FIGS. 14 and 15. In the embodiment of FIG. 13, one end of the handle 16 is looped around the tubular pouring spout 62 below the cap 63 and the other end is connected in a hole formed in the top wall 64. The end connected to the spout 62 is slidable along the length of the spout to facilitate moving the handle 61 between the storage and use positions.

Figure 16:
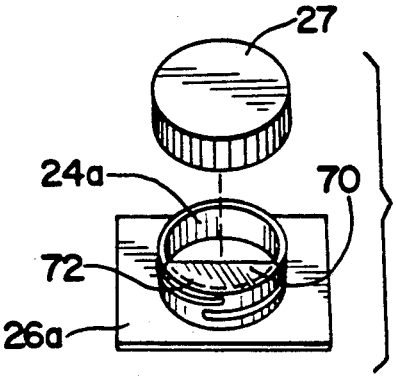

Turning now to the preferred embodiment shown in FIGS. 14–16, the container 69 includes a pouring spout 24*a* manufactured to include an internal extended flange 26*a* at the base of the spout 24*a* for securing the spout, e.g., by gluing, to an undersurface of triangular wall 21*b* with the spout 24*a* extending upwardly through the holes in triangular walls 21*b* and 21, respectively, as more particularly shown with reference to FIG. 2. Further, the spout 24*a* is manufactured to include a removable partial cover 70, perforated at its outer periphery 72 to partially block the passage of granular material through a lower portion, e.g., lower half, of spout 24*a*. The partial cover 70 will allow relatively complete filling of the container 10 without the material spilling out of spout 24*a* when the spout is first opened. After some of the container material is used, the partial cover 70 can be removed by breaking the cover 70 between perforations along the periphery 72 of the partial cover 70 so that the granular material can be poured out of the container more easily.

A preferred handle 28*a* (FIGS. 14 and 15) is well known for use on detergent boxes and includes a pair of paper sheets 74 and 76 with a strip of thin, flexible, polypropylene or polyethylene glued at its ends 78 and 80 therebetween to form gripping handle portion 29*a*. The gripping handle portion 29*a* collapses within aperture 82 in top side 15*a* and within aperture 84 in top side 15 by folding the handle portion at crease line 86 to fold the handle portion 29*a* upon itself near end 78 for stacking during shipping and storage. The two paper sheets 74 and 76 are adhesively secured to each other on their major inner surfaces to secure the gripping handle portion 29*a* thereto.

As shown in FIGS. 14 and 15, the triangular walls 21*a* and 21*c*, of FIGS. 2 and 5 have been modified for the preferred embodiment of FIGS. 14 and 15 by forming the walls as trapezoidal walls 88, fitting within complementary shaped trapezoidal cutouts 90 and 92 within top sides 15*a* and 15*b*, respectively, so that the triangular end pieces of triangular walls 21*a* and 21*c* of the embodiment shown in FIGS. 2 and 5 do not extend to an undersurface of the handle 28*a* so that the handle 28*a* can be adhesively secured to top side 15*b* without contacting trapezoidal wall 88. The container 69 of FIGS. 14 and 15 otherwise is folded together, manufactured and filled in the same manner at the container 10 of FIGS. 1-12.

It will be apparent from the foregoing that a novel and useful invention has been provided, which has numerous advantages over the prior art. The container is especially useful for holding a granular material such as cat litter. Advantages of the container include:

(1) It may be filled quickly through the bottom, which is faster than filling through a pour spout as required for a plastic jug.
(2) It may be made of a biodegradable material such as cardboard, rather than plastic.
(3) It achieves maximum space utilization with smaller shipping containers.
(4) It has a manufacturing cost which is about 50% lower than that for plastic jugs.
(5) Printing may be placed directly on the containers, rather than on labels as is true for plastic jugs.
(6) The container may be fully emptied because the pouring spout is in a corner.
(7) The pouring spout is easily resealed after pouring, without a mess.
(8) The handle makes for easy carrying and pouring.
(9) It provides for maximum shelf space utilization.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

What is claimed is:

1. A container formed form a folded blank, said container when folded and standing upright comprising:

(a) four vertical sides, a top side and a bottom side, said sides being connected and sealed to close the container, said container having the general shape of a cube;
(b) said container including a juncture where said top side meets with two of said vertical sides, an upper corner wall being formed at said juncture, and said corner wall being slanted downwardly from said top side and having a triangular configuration; and
(c) said upper corner wall having a hole formed therethrough, and a pouring spout being mounted in said hole, said spout being inset from the planes of said top side and said two of said vertical walls.

2. A container as set forth in claim 1, wherein said pouring spout comprises a tubular portion having threads thereon, one end of said tubular portion having a radially extending flange thereon, and a cap screwed on said threaded tubular portion, said flange being on the inside of said upper corner wall and said cap being on the outside of said upper corner wall.

3. A container as set forth in claim 1, wherein said top side has at least one hole formed approximately centrally therein and a handle extending slidably therethrough.

4. A container as set forth in claim 1, wherein said top side includes a plurality of sections including an innermost section, an outermost section and two intermediate sections, said intermediate sections including triangular portions forming said corner wall.

5. A container as set forth in claim 4, wherein said two intermediate sections and said outermost section have at least one hole formed therein, and a handle mounted in said hole.

6. A blank for forming a container, comprising four side sections connected by fold lines, top side sections connected to said side sections by fold lines, bottom side sections connected to said side sections and extending in an opposite direction from said top side sections, and triangular wall sections connected to two of said side sections by fold lines, said two of said side sections being connected to two of said top side sections, said triangular wall sections being adjacent said two of said top side sections, and holes for a pouring spout being formed in said triangular wall sections.

7. A blank as set forth in claim 6, wherein said four side sections include two endmost side sections, and said endmost side sections form said two of said side sections.

8. A blank as set forth in claim 7, wherein said two of said top side sections include cutouts for said triangular wall sections when said blank is folded.

9. A blank as set forth in claim 7, wherein one of said endmost side sections has a glue tab attached thereto.

10. A blank as set forth in claim 6, wherein there are four of said top side sections, and three of said four top side sections has holes therein for receiving a handle.

* * * * *